US009640894B2

(12) United States Patent
Kobayashi et al.

(10) Patent No.: US 9,640,894 B2
(45) Date of Patent: May 2, 2017

(54) CONNECTOR

(71) Applicant: YAZAKI CORPORATION, Minato-ku, Tokyo (JP)

(72) Inventors: Naoki Kobayashi, Shizuoka (JP); Akihiro Tsuruta, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 6 days.

(21) Appl. No.: 14/963,365

(22) Filed: Dec. 9, 2015

(65) Prior Publication Data

US 2016/0093968 A1 Mar. 31, 2016

Related U.S. Application Data

(63) Continuation of application No. PCT/JP2014/064981, filed on Jun. 5, 2014.

(30) Foreign Application Priority Data

Jun. 12, 2013 (JP) ..... 2013-123619

(51) Int. Cl.
*H01R 13/62* (2006.01)
*H01R 13/42* (2006.01)
(Continued)

(52) U.S. Cl.
CPC ..... *H01R 13/42* (2013.01); *H01R 13/629* (2013.01); *H01R 13/502* (2013.01); *H01R 13/62938* (2013.01)

(58) Field of Classification Search
CPC ..... H01R 13/62938; H01R 13/62955; H01R 13/62933; H01R 13/4538; H01R 13/453
(Continued)

(56) References Cited

U.S. PATENT DOCUMENTS 6,644,992 B2 * 11/2003 Maegawa ..... H01R 13/62938 439/157
6,761,568 B2 * 7/2004 Bakker ..... H01R 13/4538 439/140
(Continued)

FOREIGN PATENT DOCUMENTS

CN 101162811 A 4/2008
CN 102185210 A 9/2011
(Continued)

OTHER PUBLICATIONS

Office Action issued on Jan. 24, 2017 in the counterpart Chinese patent application.

*Primary Examiner* — Hien Vu
(74) *Attorney, Agent, or Firm* — Mots Law, PLLC

(57) ABSTRACT

A connector (1) which has: a male connector (3) provided with a locking portion (11); an aligning plate (7) which includes an engaged portion (15), and a locked portion (17) that is provided at the base side surface of a male terminal, and which prevents, when temporarily mounted to the male connector, the movement of the male terminal towards the base side by the locked portion being in contact with the locking portion; a female connector (5); and a lever (31) which includes an engaging portion (19), and makes a prescribed limited movement relative to the female connector, and when the female connector, and the aligning plate are detached from the male connector, the engaging portion engages with the engaged portion of the aligning plate, and the aligning plate is moved away from the male connector.

4 Claims, 20 Drawing Sheets

(51) Int. Cl.
*H01R 13/629* (2006.01)
*H01R 13/502* (2006.01)

(58) Field of Classification Search
USPC ..... 439/140, 141, 157, 686, 695, 374
See application file for complete search history.

(56) References Cited

U.S. PATENT DOCUMENTS

| | | | | |
|---|---|---|---|---|
| 6,846,191 | B2 * | 1/2005 | Hobbs | H01R 13/4538 439/140 |
| 7,249,958 | B2 * | 7/2007 | Ishikawa | H01R 13/631 439/140 |
| 2006/0046540 | A1 | 3/2006 | Ikeya et al. | |
| 2006/0154511 | A1 | 7/2006 | Okura | |
| 2008/0090435 | A1 | 4/2008 | Ikeya et al. | |
| 2008/0102667 | A1 | 5/2008 | Ikeya et al. | |
| 2009/0203248 | A1 | 8/2009 | Matsumura et al. | |
| 2011/0170947 | A1 | 7/2011 | Zheng et al. | |
| 2012/0034812 | A1 | 2/2012 | Tanaka et al. | |

FOREIGN PATENT DOCUMENTS

| | | | |
|---|---|---|---|
| CN | 102386525 | A | 3/2012 |
| JP | 2006-073330 | A | 3/2006 |
| JP | 2006-172825 | A | 6/2006 |
| JP | 2008-108662 | A | 5/2008 |
| JP | 2009-187865 | A | 8/2009 |

* cited by examiner

CONNECTOR

CROSS REFERENCE TO RELATED APPLICATIONS

This application is a Continuation of PCT Application No. PCT/JP2014/064981, filed on Jun. 5, 2014, and claims the priority of Japanese Patent Application No. 2013-123619, filed on Jun. 12, 2013, the content of both of which is incorporated herein by reference.

BACKGROUND

Technical Field

The present invention relates to a connector, and more particularly to a connector having an aligning plate.

Related Art

Conventionally, there has been known a connector (lever fitting type connector) 301 shown in FIGS. 1, 2A and 2B (see JP 2006-073330 A).

The connector 301 includes a female housing (female connector, female connector housing) 303, a male housing (male connector, male connector housing) 305, a moving plate 307, and a lever 309.

The moving plate 307 includes: a plate body 308 in which terminal insertion holes (insertion holes) 311 are formed; and a plurality of temporary locking portions 310 formed on the plate body 308 and temporarily locked to the female housing 303.

The temporary locking portions 310 are arranged on a plurality of straight lines which are orthogonal to a rotational axis of the lever 309 fitted in the female housing 303 such that the temporary locking portions 310 are positioned on both sides of the rotational axis.

The mounting of the male housing 305 and the moving plate 307 on the female housing 303 is performed as follows.

The moving plate 307 is set on the male housing 305. At this stage of operation, male terminal fittings (male terminals) 315 which project in the inside of a hood part 313 of the male housing 305 are respectively inserted into the terminal insertion holes 311 formed in the moving plate 307 in a corresponding manner.

Next, joining surfaces of the female housing 303 and the male housing 305 are brought into contact with each other, and are temporarily locked to each other by the temporary locking portions 310. Then, the lever 309 is inserted into the lever insertion hole 317 from a female housing 303 side with a distal end side inserted first. At this stage of operation, the lever 309 is temporarily locked to the female housing 303.

Next, by operating portions 319, 321 of the temporarily locked lever 309 in a counterclockwise direction, distal end portions of screw grooves 323, 325 accommodate engaging projections 329 of a lever engaging plate 327, and the female housing 303 and the male housing 305 are engaged with each other by fitting engagement by being pulled to each other.

Then, at the time of completion of fitting engagement between the female housing 303 and the male housing 305, as shown in FIG. 2A, a locking projection 333 of a repulsive member 331 arranged on a side of the lever insertion hole 317 formed in the female housing 303 is locked to a distal end portion of the temporary locking member 335 of the moving plate 307 thus holding the moving plate 307. At the same time, as shown in FIG. 2B, a locking projection 339 formed in a projecting manner on a repulsive member 337 formed on an outer side wall of the fitting portion of the female housing 303 locks a distal end portion of the temporary locking member 341 of the moving plate 307 thus holding the moving plate 307.

Conventionally, there has been also known a connector (a connector equipped with an aligning plate) 351 shown in FIGS. 3 to 5 (see JP 2009-187865 A).

The connector 351 equipped with an aligning plate includes a connector housing (male connector) 353 having a fitting space 355, and an aligning plate 359 movably arranged in the fitting space 355 and positioning a male terminal 357 at a prescribed position. In the inside of the connector housing 353, a temporary locking hook 367 which holds a plate portion 365 of the aligning plate 359 formed of an arm portion 361 and a projecting portion 363 at a temporary locking position is mounted. An indentation 369 formed on a surface of the plate portion 365 as a result of the plate portion 365 being forcibly pressed to a depth side of the fitting space 355 by a hand of an operator or a connector other than a fitting counterpart is brought into pressure contact with the projecting portion 363 and hence, a contact portion N which is in contact with an inner surface of the indentation 369 is formed where a vector P2 which pulls the arm portion 361 toward the inside of the fitting space is generated.

SUMMARY OF THE INVENTION

In the meantime, according to the connector 301 described in JP 2006-073330 A, the aligning plate is unfortunately pushed in due to large load applied. For example, when the aligning plate is pushed in toward the male housing, the temporal lock state of the aligning plate is easily released, so that the aligning plate moves toward the male housing according to the structure illustrated in FIGS. 2A and 2B.

In the connector 351 described in JP 2009-187865 A, the structure for lifting the aligning plate is not provided and hence, there exists a drawback that it is difficult to remove the aligning plate once mounted on the male housing from the male housing.

The present invention has been made in view of the above-mentioned drawbacks, and it is an object of the present invention to provide a connector having a male connector, a female connector, and an aligning plate, wherein the aligning plate is not moved toward the male connector even when a strong force (load) is applied in a temporarily locked state, and the aligning plate, once mounted, can be easily removed from the male connector.

A connector according to the present invention includes a male connector, an aligning plate, a female connector, and a lever, in which the male connector is provided with a male terminal and a locking portion, the aligning plate engages with the male terminal and is movable with respect to the male connector in a protruding direction of the male terminal in order to perform at least protection of the male terminal or correction of alignment of the male terminal, the aligning plate is provided with a locked portion and the male terminal on a surface closer to a base end of an engaged portion, and the locked portion abuts against the locking portion of the male connector in a state where the aligning plate is temporarily installed in the male connector, whereby movement of the male terminal toward the base end is prevented, the female connector is configured to be installed into the male connector together with the aligning plate by moving toward the male connector, and the lever is provided with an engaging portion and provided on the female connector so as to make predetermined constrained motion with respect to the female connector, the lever is configured such that the engaging portion engages with an engaged portion of the aligning plate by making the constrained motion with respect to the female connector in a predetermined direction during detachment of the female connector and the aligning plate from the male connector from a state where the aligning plate and the female connector are installed in the male connector, and the lever is configured so as to move the aligning plate away from the male connector.

The predetermined constrained motion of the lever included in the connector according to the present invention may be a constrained motion of a link opposite to a fixed link where the female connector is assumed as the fixed link of quadric chain, during detachment of the female connector and the aligning plate from the male connector from the state where the aligning plate and the female connector are installed in the male connector, the engaged portion of the aligning plate may be engaged with the engaging portion of the lever until the aligning plate comes to the temporal installation state, and the aligning plate may be configured to prevent movement of the male terminal toward a tip end in the temporal installation state.

The lever included in the connector according to the present invention may be formed with an arc-shaped first through hole and an arc-shaped second through hole, the female connector may be provided with a cylinder shaped first protrusion and a cylinder shaped second protrusion, and the first protrusion may be inserted into the first through hole, the first through hole and the first protrusion engage with each other as a pair, the second protrusion is inserted into the second through hole, and the second through hole and the second protrusion engage with each other as a pair.

The engaged portion of the aligning plate included in the connector according to the present invention may be configured as an L-shaped projecting portion that protrudes from a main body of the aligning plate and can be regarded as a rigid body, the engaging portion of the lever may be configured as a protrusion that protrudes from a main body of the lever and can be regarded as a rigid body, and when the engaging portion of the lever engages with the engaged portion of the aligning plate, the protrusion of the lever may be abutted against a bent portion of a tip end of the L-shaped projecting portion of the aligning plate.

According to the present invention, the connector which includes the male connector, the female connector and the aligning plate can acquire the following advantageous effects. Therefore, the aligning plate is prevented from moving toward the male connector even when a strong force (load) is applied to the connector in a temporarily locked state. Further, it is possible to provide the connector where the aligning plate, once mounted, can be easily removed from the male connector.

DETAILED DESCRIPTION

An embodiment of the present invention is described in detail with reference to drawings.

In this specification, it must be noted that drawings are schematic views, and constitutions of devices and systems are different from constitutions of an actual device. Accordingly, the specific constitutions should be determined by taking into account the description made hereinafter. Further, it is also needless to say that the respective drawings include portions having different constitutions.

The embodiment of the present invention described hereinafter is provided for exemplifying a device and a method which embody the technical concept of the present invention, and the technical concept of the present invention does not limit materials, shapes, structures, arrangements and the like of the respective constitutional parts to the followings. Various modifications are conceivable with respect to the technical concept of the present invention within the technical scope described in claims.

Figure 1:
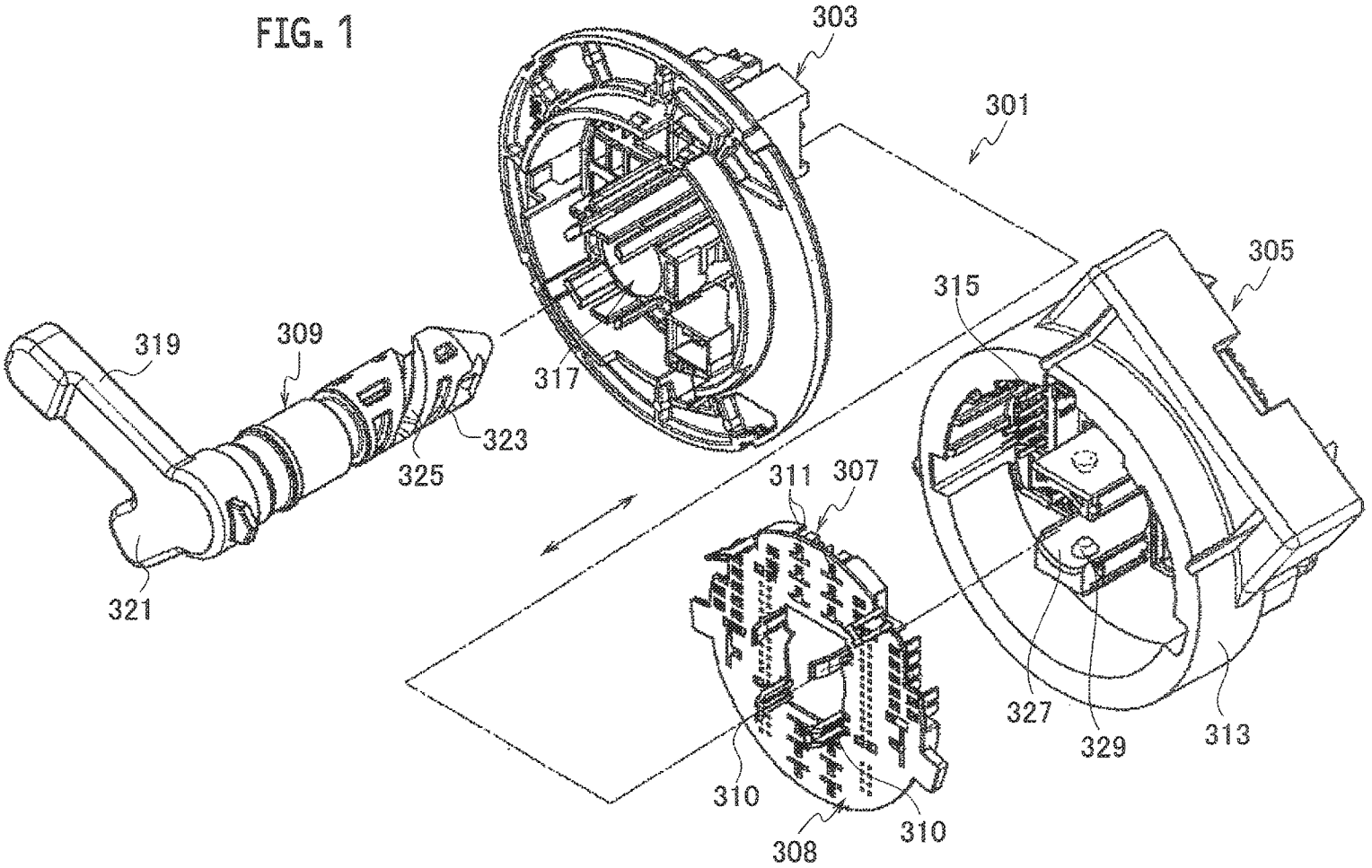
FIG. 1 is a drawing illustrating a conventional connector.
Figure 2A:
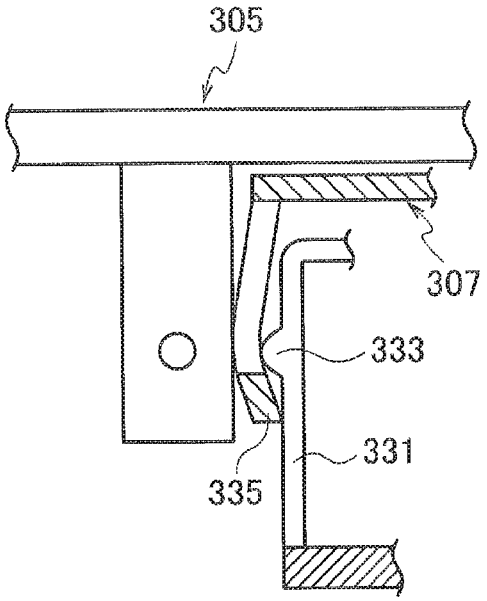
FIG. 2A is a drawing illustrating an engagement state of a moving plate and a side of a female housing of the conventional connector.
Figure 2B:
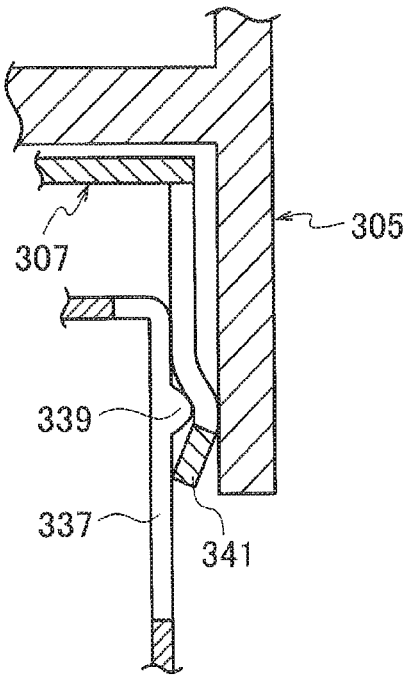
FIG. 2B is a drawing illustrating a lock state of the moving plate and the side of the female housing of the conventional connector.
Figure 3:
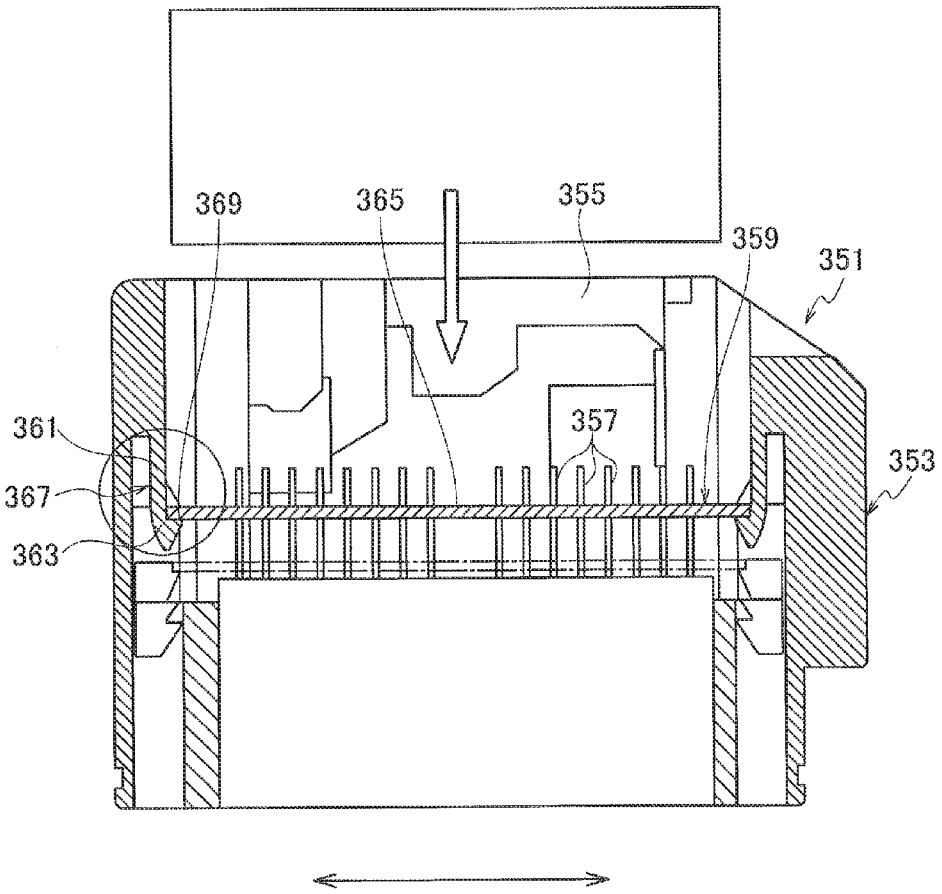
FIG. 3 is a drawing illustrating a conventional connector.
Figure 4A:
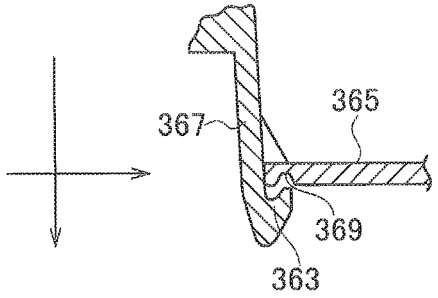
FIG. 4A is a drawing illustrating the conventional connector in a state before an aligning plate is held by a temporary locking hook.
Figure 4B:
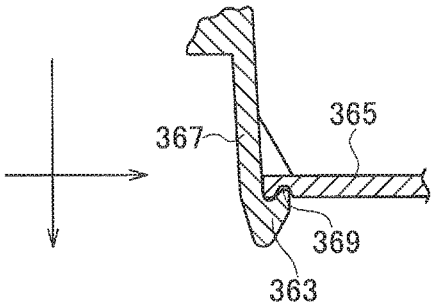
FIG. 4B is a drawing illustrating the conventional connector in a state before the aligning plate is held by the temporary locking hook.
Figure 4C:
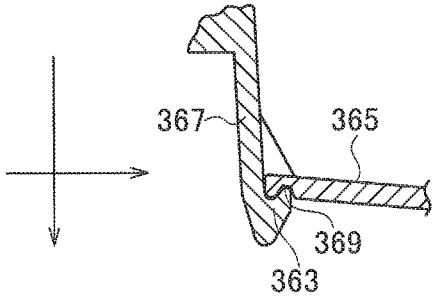
FIG. 4C is a drawing illustrating a state where the aligning plate held by the temporary locking hook of the conventional connector is pressed.
Figure 4D:
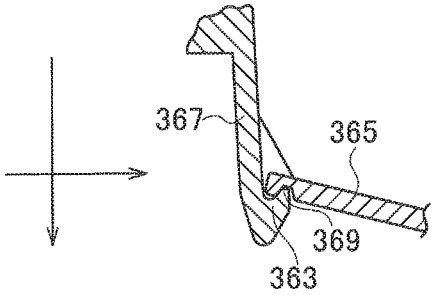
FIG. 4D is a drawing illustrating a state where the aligning plate illustrated in FIG. 4C is pressed with larger force.
Figure 5:
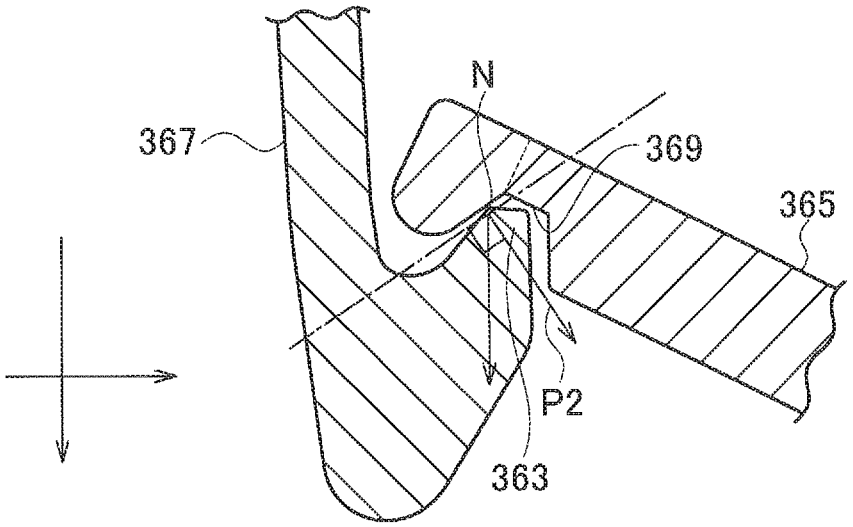
FIG. 5 is a drawing illustrating the conventional connector.
Figure 6:
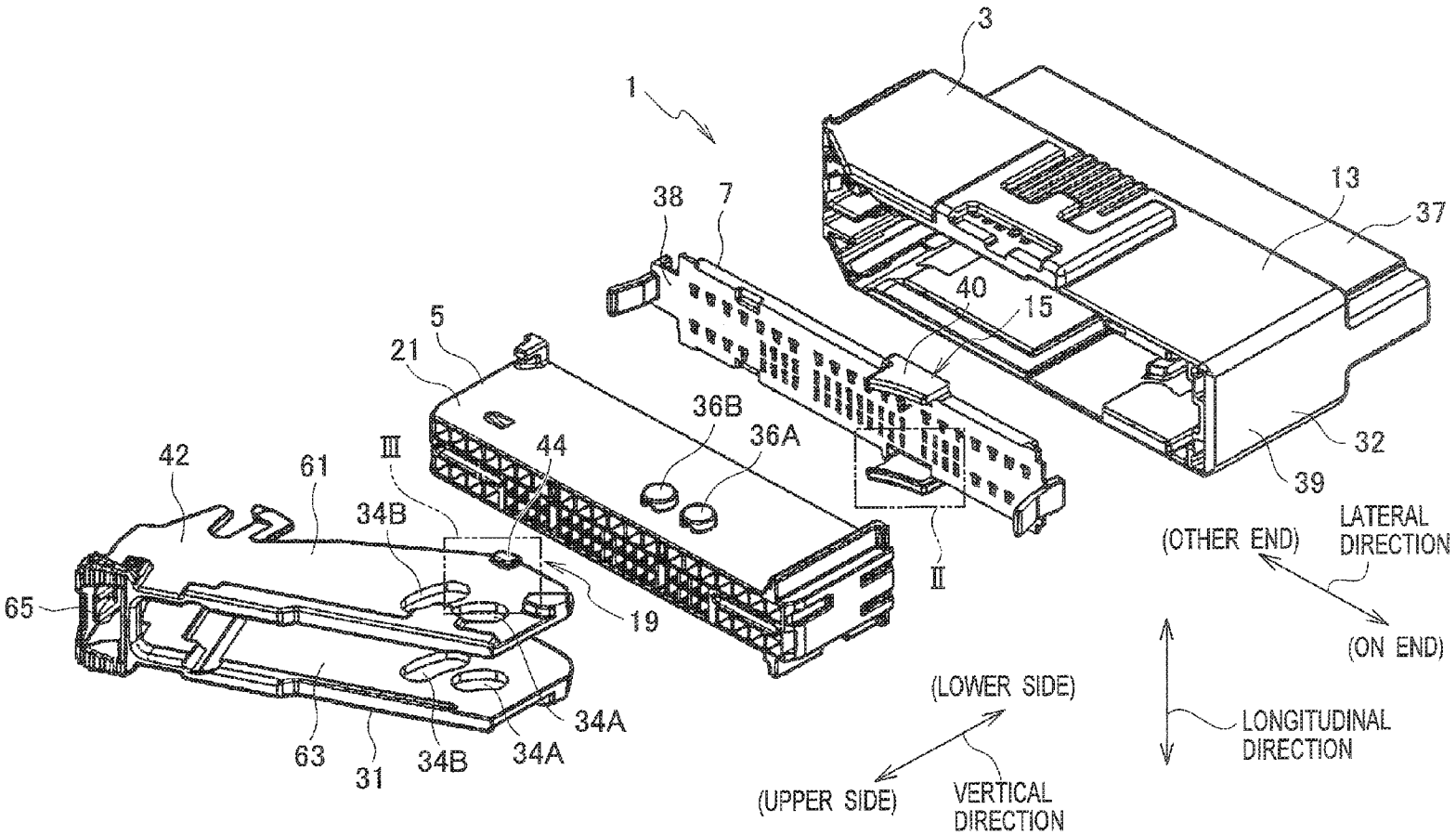
FIG. 6 is a perspective view of a connector according to an embodiment of the present invention, and a drawing illustrating a state where a female connector and an aligning plate are detached from a male connector.

A connector 1 according to the embodiment of the present invention, as shown in FIG. 6 and the like, includes a male connector 3, a female connector 5, an aligning plate (moving plate) 7, and a lever 31.

Hereinafter, for the sake of convenience of the description, there may be a case where predetermined three directions in a space are referred to as a longitudinal direction, a lateral direction and a vertical direction respectively. The longitudinal direction, the lateral direction and the vertical direction are orthogonal to each other.

Figure 10:
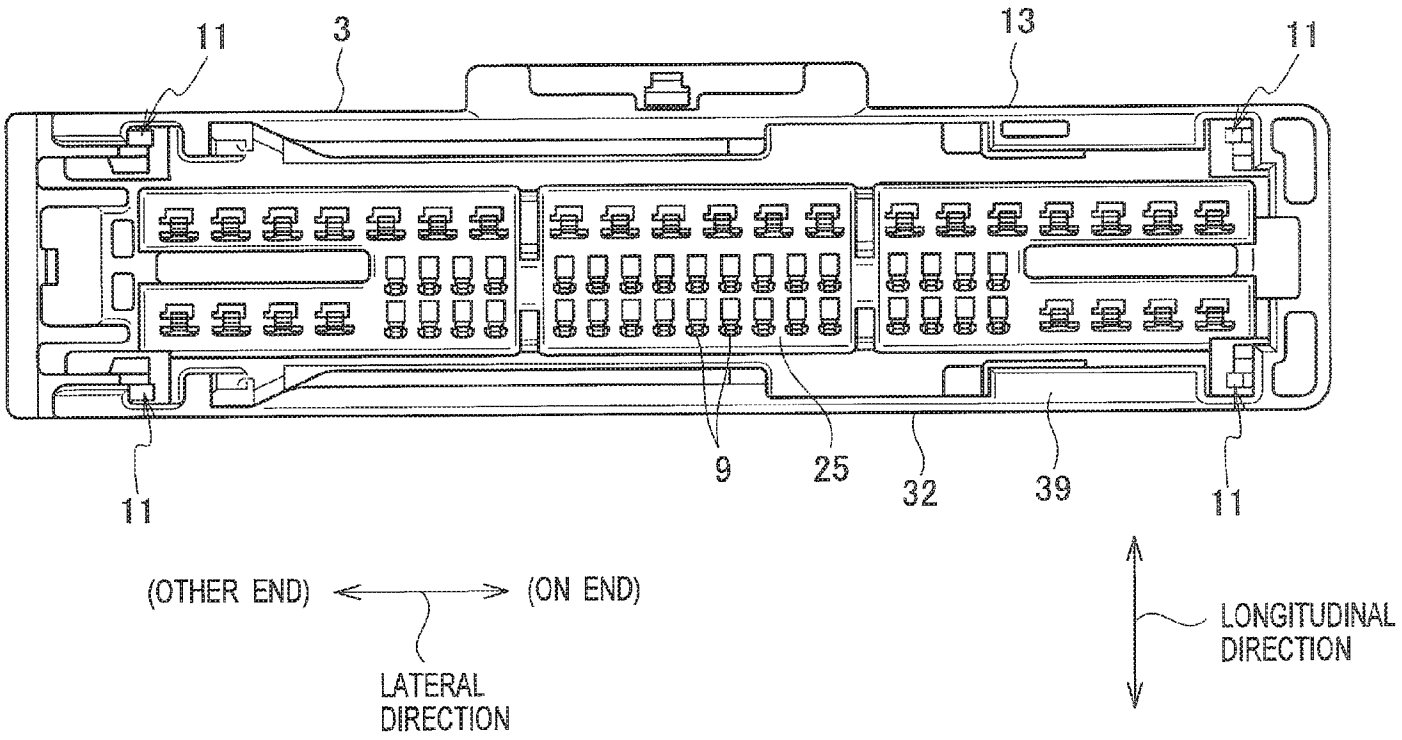
FIG. 10 is a view on arrow V in FIG. 9.

As shown in FIG. 10 and the like, the male connector 3 includes terminal accommodating chambers 9 in which a male terminal not shown in the drawings (male tub, male terminal fitting) is accommodated respectively, and a locking portion (for example, a plate holding arm) 11. In the male connector 3, the male terminals are mounted in the male connector housings 13, and the locking portion 11 is formed of a portion of the male connector housing 13.

The male connector housing 13 is formed by integral molding using an electrically insulating material such as a synthetic resin, for example. Each male terminal is formed into an elongated rod shape and the male terminals are arranged at predetermined intervals in the direction (longitudinal direction or lateral direction) orthogonal to the longer direction (vertical direction).

The aligning plate 7 is configured to engage with the male terminals so as to perform at least one of the protection of the male terminals and the correction of alignment of the male terminals (for example, the protection of the male terminals or the correction of alignment of the male terminals). The aligning plate 7 is configured to be movably engageable with the male connector 3 in a projecting direction of the male terminals (in the longer direction; in the vertical direction).

Figure 13A:
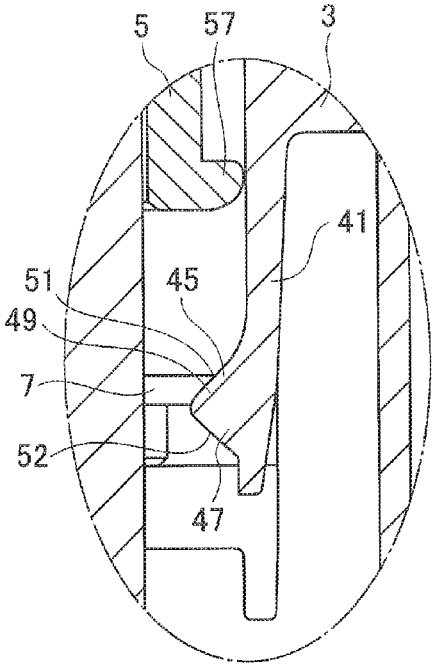
FIG. 13 A is an enlarged view of a part XIIIA in FIG. 12.
FIG. 13B is a locking portion and a locked portion in the state of FIG. 12.
Figure 13B:
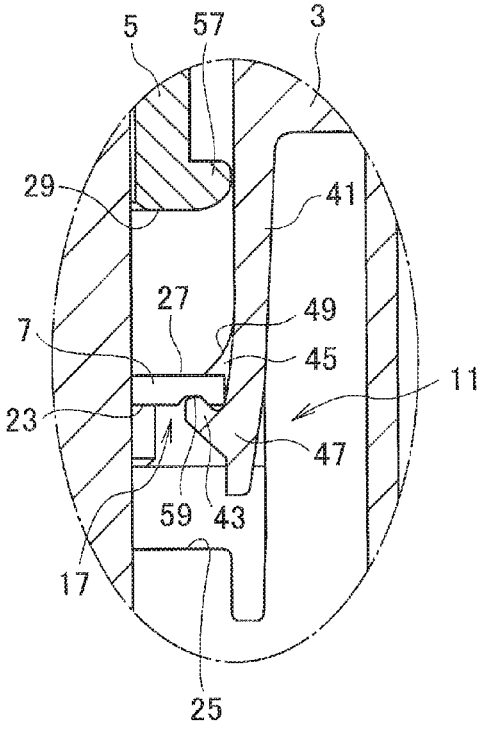
Figure 14:
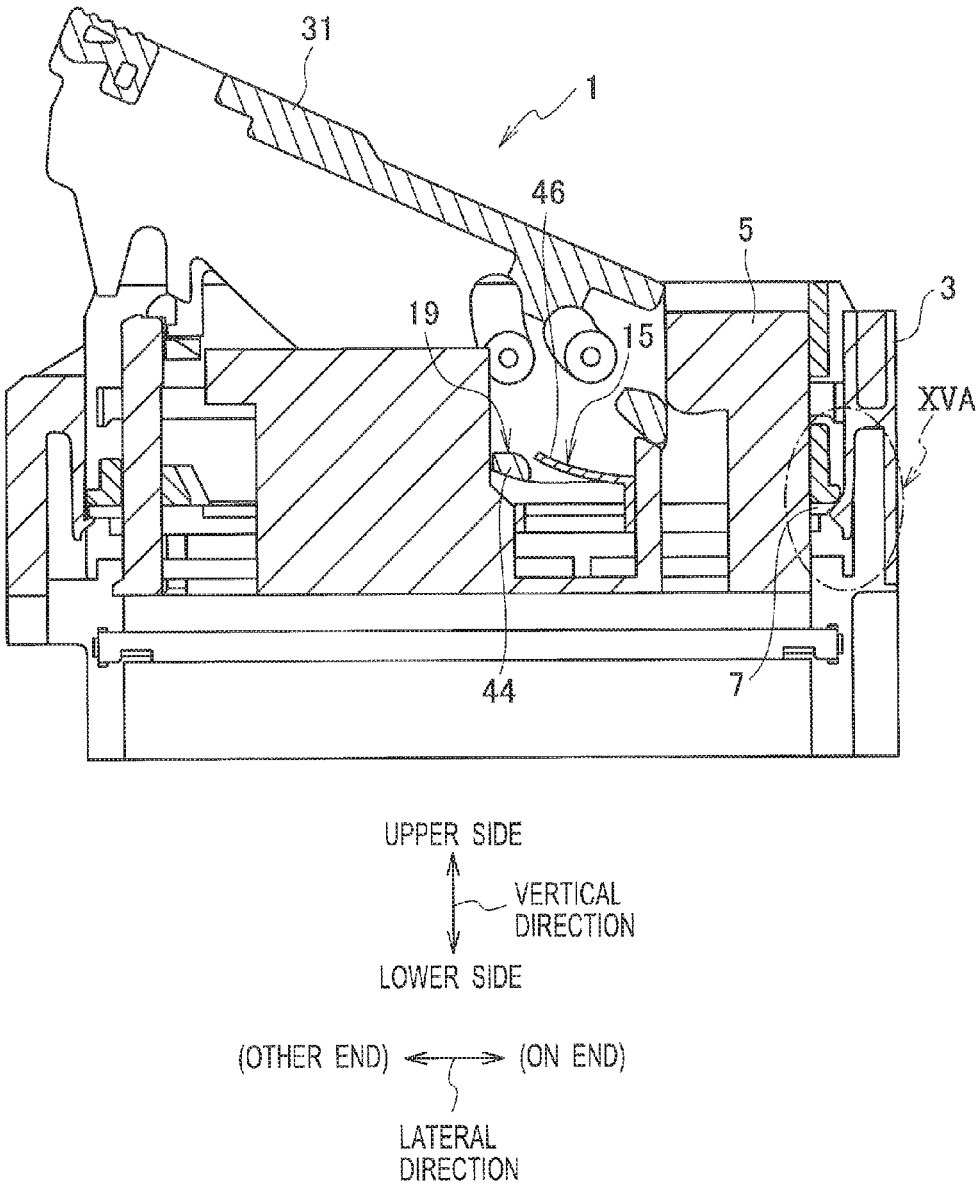
FIG. 14 is a drawing illustrating operation of the connector according to the embodiment of the present invention.

An aligning plate 7 is integrally molded from an electrically insulating material such as synthetic resin and includes engaged portions 15 (refer to FIG. 6 and other drawings) and locked portions 17 (refer to FIG. 13B and other drawings). The locked portions 17 are formed on the surface closer to the base end of male terminals (the lower surface of the aligning plate 7) and are configured to abut against locking portions 11 of a male connector 3.

Figure 12:
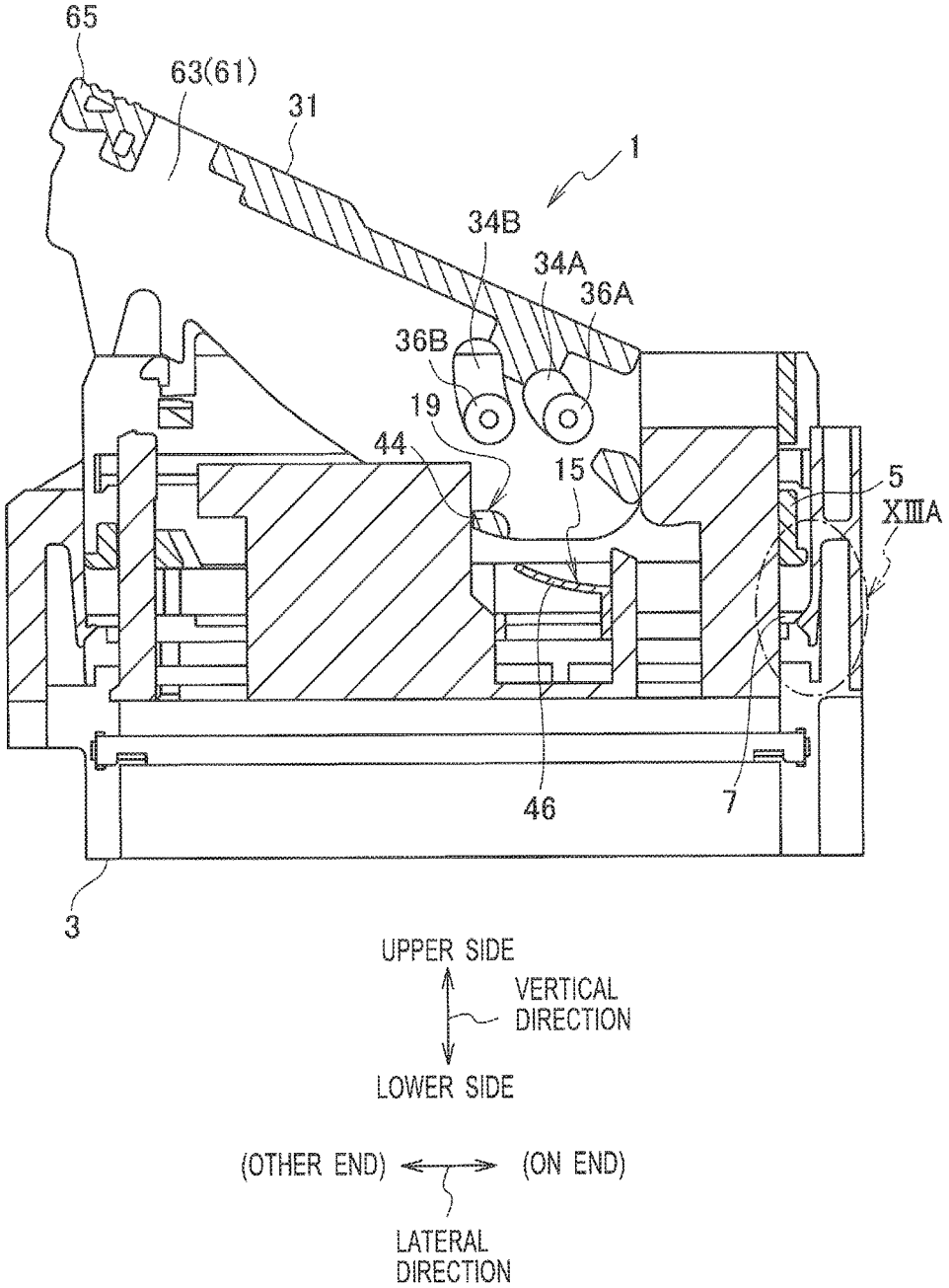
FIG. 12 is a view illustrating operation of the connector according to the embodiment of the present invention.

As illustrated in FIGS. 12, 13A, and 13B, the aligning plate 7 is configured to be locked to the locking portions 11 of the male connector 3, supported from the lower side, and thus prevented from moving toward the base end of the male terminals (lower side in FIGS. 12, 13A, and 13B) because the locked portions 17 abut against the locking portions 11 of the male connector 3 in a state where the aligning plate 7 is temporarily installed in the male connector 3.

In a state where the aligning plate 7 is temporarily mounted in the male connector 3, the aligning plate 7 is located at a predetermined position on an intermediate portion of the male terminals in the longer direction of the male terminals.

In addition, as to be described later in detail, when the aligning plate 7 is temporarily installed in the male connector 3, the aligning plate 7 is pinched by the locking portions 11 of the male connector 3 in the lateral direction, thereby being configured not to easily move upward. Note that, when the aligning plate 7 is temporally installed in the male connector 3, the absolute value of force moving the aligning plate 7 downward is larger than the absolute value of force moving the aligning plate 7 upward.

Figure 20:
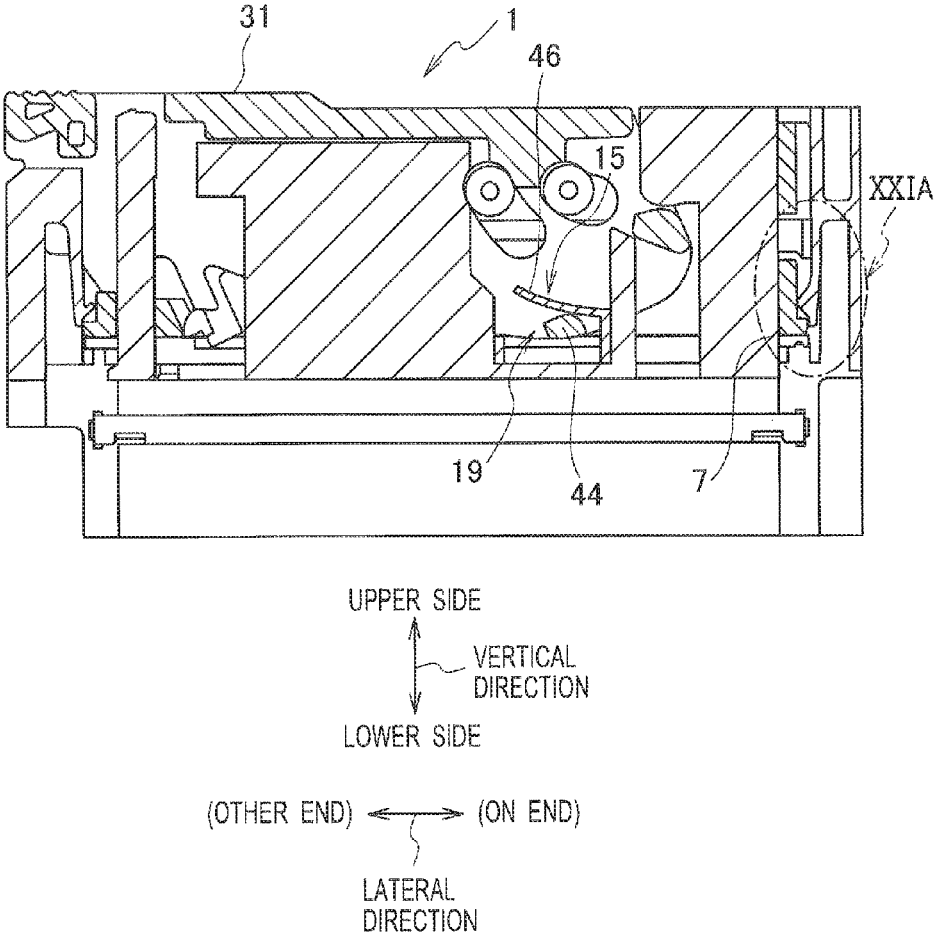
FIG. 20 is a drawing illustrating the connector according to the embodiment of the present invention.
Figure 21A:
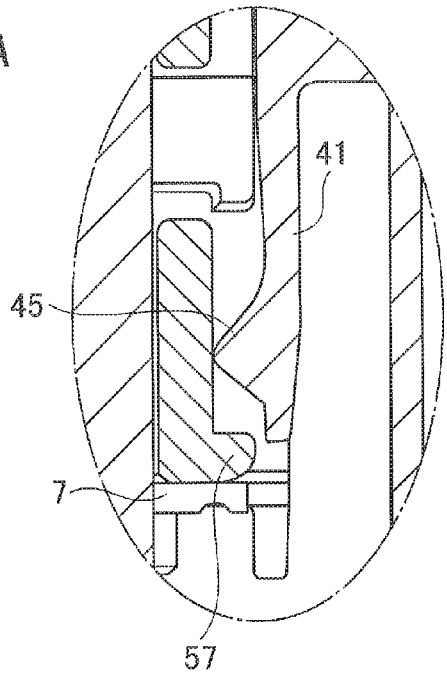
FIG. 21A is an enlarged view of a part XXIA in FIG. 20.
Figure 21B:
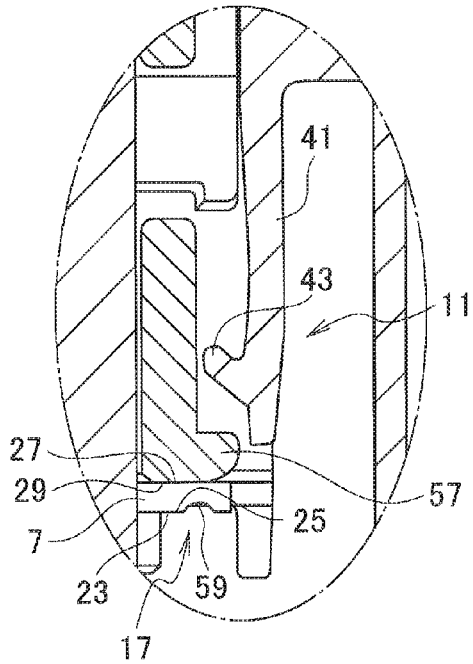
FIG. 21B is a drawing illustrating the locking portion and the locked portion in the state of FIG. 20.

The female connector 5 is configured to be integrally mounted on the male connector 3 together with the aligning plate 7 by being moved toward a male connector 3 side (a lower side: a proximal end side of the male terminal) in the longer direction (vertical direction) of the male terminal (see FIGS. 20, 21A, and 21B).

A female connector 5 includes female terminals (not illustrated) connected to the male terminals. In the female connector 5, the female terminals (female terminal fittings) are provided in a female connector housing 21.

The female terminals are connected to the male terminals by moving the female connector 5 toward the male connector 3 (a lower side). In moving the female connector 5 toward the male connector 3 (a lower side), a state where the aligning plate 7 is temporarily mounted on the male connector 3 (a state shown in FIG. 13B) is released (the locking portion 11 of the male connector 3 being released from the locked portion 17 of the aligning plate 7 as shown in FIG. 17B), and the aligning plate 7 is pushed toward the male connector 3 (a lower side) (see FIGS. 19A, 19B, and the like) by the female connector 5 thus being moved together with the female connector 5.

In a state where the female connector 5 is connected to the male connector 3 (a state where mounting of the female connector 5 and the aligning plate 7 in the male connector 3 is finished as shown in FIGS. 20, 21A, and 21B), a lower surface 23 of the aligning plate 7 is brought into contact with an upper surface 25 which is a portion of the male connector housing 13 from which the male terminals project, an upper surface 27 of the aligning plate 7 is brought into contact with a lower surface 29 which is a portion of the female connector housing 21 where the female terminals are mounted and hence, the female connector 5, the aligning plate 7, and the male connector 3 are integrally formed with each other.

The lever 31 is provided for reducing a force necessary to mount the female connector 5 in the male connector 3 using principle of leverage. That is, when a multipole housing (the male terminals of the male connector 3 and the female terminals of the female connector 5 being large in numbers) is used, a large force becomes necessary in connecting the respective female terminals to the respective male terminals simultaneously. However, with the use of the lever 31, a force necessary for connecting the respective female terminals to the respective male terminals can be reduced.

A lever 31 is provided with engaging portions 19 as illustrated in FIG. 6 and other drawings. The lever 31 is integrally molded from an electrically insulating material such as synthetic resin, and the engaging portions 19 are formed from parts of the lever 31, for example.

In more detail, the lever 31 is provided to the female connector 5, and configured to make predetermined constrained motion (including rotation) with respect to the female connector 5. When the female connector 5 and the aligning plate 7 are detached from the male connector 3 from the state where the aligning plate 7 and the female connector 5 are installed in the male connector 3 (the state where installation is completed as illustrated in FIGS. 20, 21A, and 21B), the lever 31 makes the constrained motion with respect to the female connector 5 in a predetermined direction. Thus, the engaging portions 19 engage with the engaged portions 15 of the aligning plate 7, and the aligning plate 7 moves away from the male connector 3 (upward).

Note that, a connector 1 can be regarded as a rigid body except for the locking portions 11 of the male connector 3 (to be described in more detail below). Specifically, a main body 32 (a male connector housing 13 except for the locking portions 11) of the male connector 3, whole of the aligning plate 7 including the engaged portions 15 and the locked portions 17, and whole of the lever 31 including the engaging portions 19 can be regarded as rigid bodies. In other words, the connector 1 except for the locking portions 11 of the male connector 3 is hardly deformed by force acting on the connector 1 during actual use, and is configured to allow slight elastic deformation that cannot be recognized as deformation with the naked eye.

In addition, during and after installation of the female connector 5 together with the aligning plate 7 in the male connector 3, and during detachment of the female connector 5 together with the aligning plate 7 from the male connector 3, the lever 31 continues to engage with the male connector 3. When the lever 31 is moved in one predetermined direction with respect to the female connector 5, the female connector 5 moves together with the aligning plate 7 toward the male connector 3 (lower side) (moves with respect to the male connector 3), and the female connector 5 and the aligning plate 7 are installed in the male connector 3. When the lever 31 is moved in a direction opposite to the one predetermined direction with respect to the female connector 5, the female connector 5 moves together with the aligning plate 7 away from the male connector 3 (upward) (moves with respect to the male connector 3), and the female connector 5 and the aligning plate 7 are detached from the male connector 3.

Meanwhile, the lever 31 is provided with an engaged portion for male connector, and the male connector 3 is provided with an engaging portion for lever. The lever 31 and the male connector 3 are configured such that the female connector 5 and the aligning plate 7 moves in the vertical direction with respect to the male connector 3 when the engaging portion for lever engages with the engaged portion for male connector, and the lever 31 makes constrained motion. In addition, the lever 31 also moves in the vertical direction together with the female connector 5.

The constrained motion of the lever 31 with respect to the female connector 5 is not merely rotation but may be as described below as an example. That is, assuming that the female connector 5 is a fixed link of quadric chain in kinematics, the lever 31 is configured to make constrained motion of a link opposite to the fixed link.

In more detail, assuming the quadric chain is a lever crank mechanism (for example a mechanism other than a parallel link mechanism), the lever 31 is configured to make constrained motion of a connecting rod with respect to the female connector 5, which is a fixed link.

During detachment of the female connector 5 and the aligning plate 7 from the male connector 3 in the state where the aligning plate 7 and the female connector 5 are installed in the male connector 3 (state illustrated in FIGS. 20, 21A, and 21B), the engaged portions 15 of the aligning plate 7 are engaged with the engaging portions 19 of the lever 31 until the aligning plate 7 comes to the temporal installation state.

During detachment of the female connector 5 and the aligning plate 7 from the male connector 3 from the state where the aligning plate 7 and the female connector 5 are installed in the male connector 3, the engaging portions 19 of the lever 31 are separated from the engaged portions 15 of the aligning plate 7 when the aligning plate 7 comes to the temporal installation state.

In addition, the aligning plate 7 is configured such that movement toward the tip end of the male terminals (upper side) is strictly prevented in the temporal installation state.

Even with further movement of the lever 31 (movement in a direction causing the aligning plate 7 and the female connector 5 to move away from the male connector 3), the temporal installation state of the aligning plate 7 is maintained.

The aligning plate 7 is formed into a rectangular flat plate shape, and a plurality of through holes is formed in the aligning plate 7 in a penetrating manner in the thickness direction (vertical direction). Since the respective male terminals are inserted into the respective through holes, the aligning plate 7 engages with the male terminals.

Engagement of predetermined portions on the both ends in the lateral direction and predetermined positions on the both ends in the longitudinal direction of the aligning plate 7 with the locking portions 11 of the male connector 3 as illustrated in FIG. 13B and other drawings, the aligning plate 7 is positioned with respect to the male connector 3 in the lateral direction and the longitudinal direction.

As illustrated in FIG. 6 and other drawings, the lever 31 is formed with first through holes (or recessed parts) 34A having an arc shape and second through holes (or recessed parts) 34B having an arc shape, and the female connector 5 is formed with first protrusions 36A having a cylinder shape and second protrusions 36B having a cylinder shape.

As illustrated in FIG. 12 and other drawings, each of the first protrusions 36A is inserted into corresponding one of the first through holes 34A, and the first through hole 34A and the first protrusion 36A form a pair and are engaged with each other. In addition, each of the second protrusions 36B is inserted into corresponding one of the second through holes 34B, and the second through hole 34B and the second protrusion 36B form a pair and are engaged with each other.

Thus, the constrained motion of the link opposite to the fixed link as described above with respect to the female connector 5 is made by the lever 31.

Each of the engaged portions 15 of the aligning plate 7 include an L-shaped projecting portion 40 that protrudes from a main body 38 of the aligning plate 7 as illustrated in FIG. 6 and other drawings and can be regarded as a rigid body. Each of the engaging portions 19 of the lever 31 protrudes from a main body 42 of the lever 31, and includes a protruding portion 44 that can be regarded as a rigid body.

Figure 18:
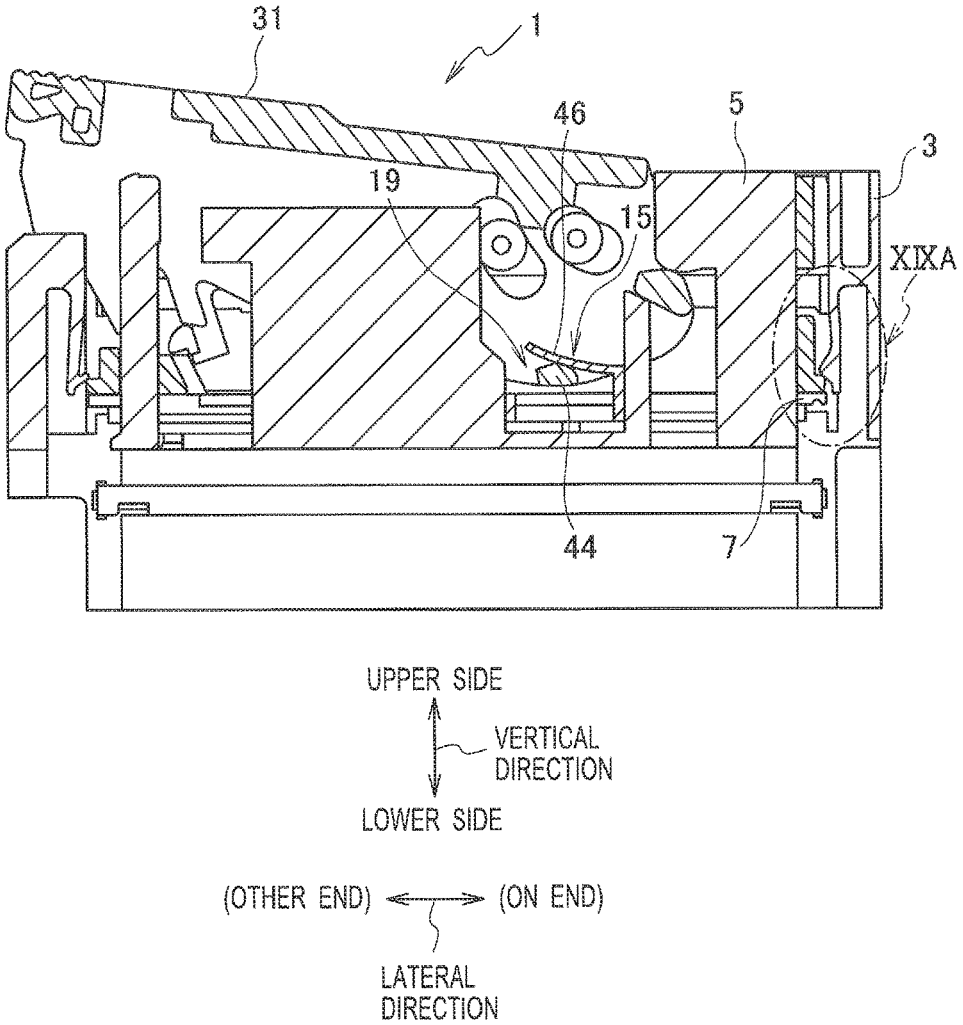
FIG. 18 is a drawing illustrating operation of the connector according to the embodiment of the present invention.

As illustrated in FIGS. 18 and 20 and other drawings, when the engaging portions 19 of the lever 31 engage with the engaged portions 15 of the aligning plate 7, the protruding portions 44 of the lever 31 are positioned lower than bent portions (protruding edges) 46 of the tip end of the L-shaped projecting portions 40 of the aligning plate 7.

When the female connector 5 and the aligning plate 7 are detached from the male connector 3 from the state where the aligning plate 7 and the female connector 5 are installed in the male connector 3 as illustrated in FIGS. 14, 16, 18, and 20, the protruding portions 44 of the lever 31 keep abutting against the bent portions 46 of the tip ends of the L-shaped projecting portions 40 of the aligning plate 7 until the aligning plate 7 comes in the temporal installation state.

The connector 1 is described in more detail hereinafter.

Figure 9:
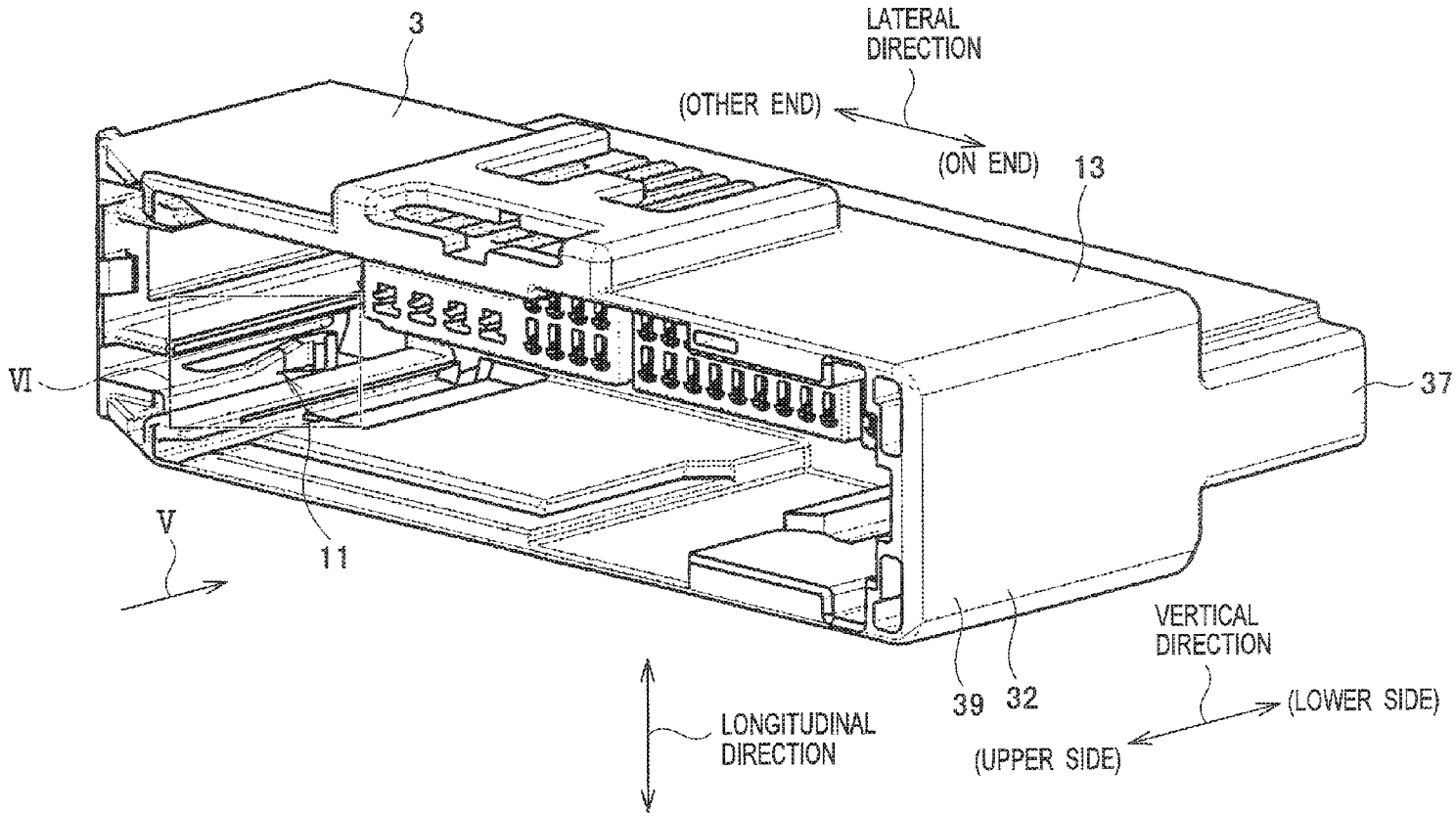
FIG. 9 is a perspective view of the male connector according to the embodiment of the present invention.

As shown in FIG. 6, FIG. 9, and FIG. 10 and the like, the male connector main body 32 of the male connector housing 13 includes a bottom portion 37, and a hood portion (side wall portion) 39 which projects upward from the whole outer periphery of the bottom portion 37. The male terminals project upward from the upper surface 25 of the bottom portion 37 inside the hood portion 39.

The hood portion 39 is formed into a hollow square shape as viewed in the vertical direction, the respective male terminals are positioned inside the hood portion 39, and the respective male terminals are arranged at predetermined intervals in the longitudinal direction as well as in the lateral direction.

Figure 11:
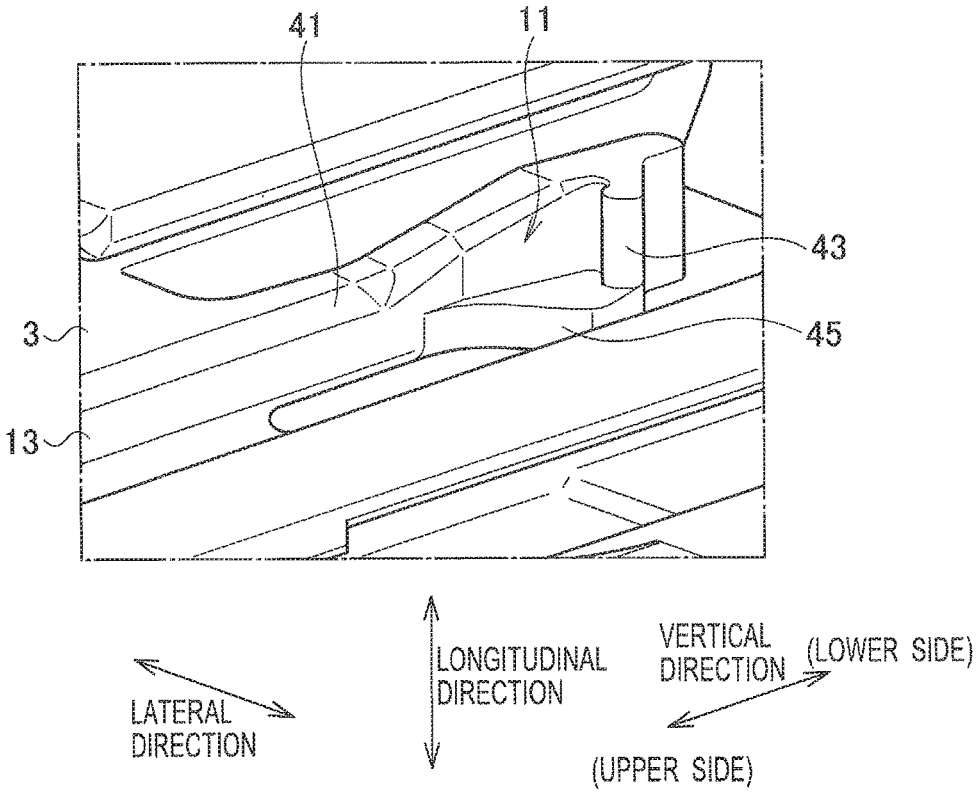
FIG. 11 is an enlarged view of a part VI in FIG. 9.

Each of the locking portions 11 of the male connector 3 include an elastic arm 41 extending inside a hood portion 39 from an opening at the upper end of the hood portion 39 toward a bottom part 37 (lower side), a hook portion 43 provided at the tip end (bottom end) of the elastic arm 41, and an abutting portion 45 provided at the tip end of the elastic arm 41 as illustrated in FIG. 11 and other drawings. The tip end (bottom end) of the elastic arm 41 is separated from the bottom part 37, and the elastic arm 41 is in a form of a cantilever. The locking portions 11 of the male connector 3 are configured such that only the elastic arms 41 bend.

As shown in FIG. 10 and the like, four locking portions 11 (elastic arms 41) of the male connector 3 are provided, for example. Among these elastic arms 41, two elastic arms 41 are formed on the hood portion 39 positioned at one end in the lateral direction, and other two elastic arms 41 are formed on the hood portion 39 positioned at the other end in the lateral direction. Further, four elastic arms 41 are positioned in the vicinity of respective corner portions of the hood portion 39 having a rectangular shape respectively.

As shown in FIGS. 10, 13A, 13B, and the like, the pawl portion 43 and the contact portion 45 project toward the center of the hood portion 39 in the lateral direction. Further, the contact portion 45 is positioned outside the pawl portion 43 (a side opposite to a center side of the male connector housing 13) in the longitudinal direction.

A distal-end-side portion (a lower portion) of the elastic arm 41 is slightly bent toward the center of the male connector housing 13 in the lateral direction (see FIG. 13B and the like). With such a configuration, a distance (a lateral size) between the elastic arm 41 which is formed on the hood portion 39 positioned at one end in the lateral direction and the elastic arm 41 which is formed on the hood portion 39 positioned at the other end in the lateral direction is set to a fixed value at proximal-end-side portions (upper side portions) of the elastic arms 41. However, the distance is slightly but gradually decreased at distal-end-side portions of the elastic arms 41 as the elastic arms 41 extend downward.

As shown in FIG. 13B and the like, the pawl portion 43 projects from a portion of the elastic arm 41 in the vicinity of the distal end of the elastic arm 41 slightly upward (toward an opening portion side of the hood portion 39). The contact portion 45 is fixed to the pawl portion 43, and the contact portion 45 includes an overlapping portion 47 which overlaps with the pawl portion 43 as viewed in the longitudinal direction, and an upper portion 49 which projects upward from the overlapping portion 47 (see FIGS. 13A, 13B, and the like). An inclined guide surface 51 is formed on an upper end side of the upper portion 49. Further, an inclined guide surface 52 is formed also on lower end sides of the pawl portion 43 and the contact portion 45.

The aligning plate 7 is formed to have a rectangular flat shape. The longitudinal dimension thereof is slightly smaller than the dimension between the abutting portions 45 on the tip ends of the elastic arms 41 provided as a pair on the both ends in the longitudinal direction, and the lateral dimension of the aligning plate 7 is smaller than the dimension between the elastic arms 41 provided as a pair on the both ends in the lateral direction.

The aligning plate 7 is mounted in the male connector 3 such that a thickness direction of the aligning plate 7 is directed in the vertical direction, the longitudinal direction of the aligning plate 7 agrees with the longitudinal direction of the hood portion (the male connector 3) 39, and the lateral direction of the aligning plate 7 agrees with the lateral direction of the hood portion 39.

Thus, in the temporal installation state in the male connector 3, the aligning plate 7 is sandwiched between the pair of abutting portions 45 in the longitudinal direction and sandwiched between the pair of elastic arms 41 in the lateral direction, thereby being positioned with respect to the male connector 3 in the vertical and lateral directions. Therefore, the aligning plate 7 is configured not to easily (for example, due to vibration upon delivery) move upward with respect to the male connector 3 in the temporal installation state.

As shown in FIG. 13B and the like, the locked portion 17 of the aligning plate 7 include a recessed portion 59 which is formed on a lower surface (a surface on the proximal end side of the male terminals) of the aligning plate 7. The recessed portion 59 formed on the locked portion 17 of the aligning plate 7 is formed in the vicinity of both ends of the aligning plate 7 in the lateral direction.

Figure 7:
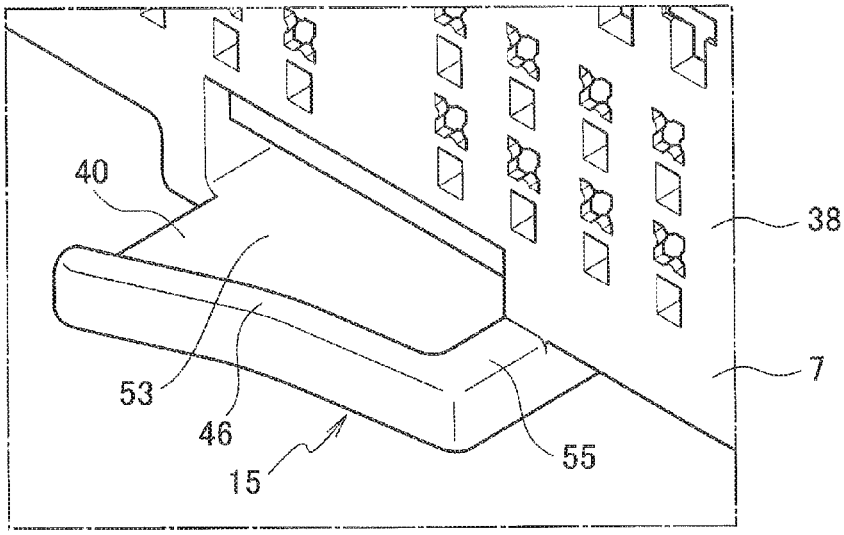
FIG. 7 is an enlarged view of a part II of FIG. 6.
Figure 8:
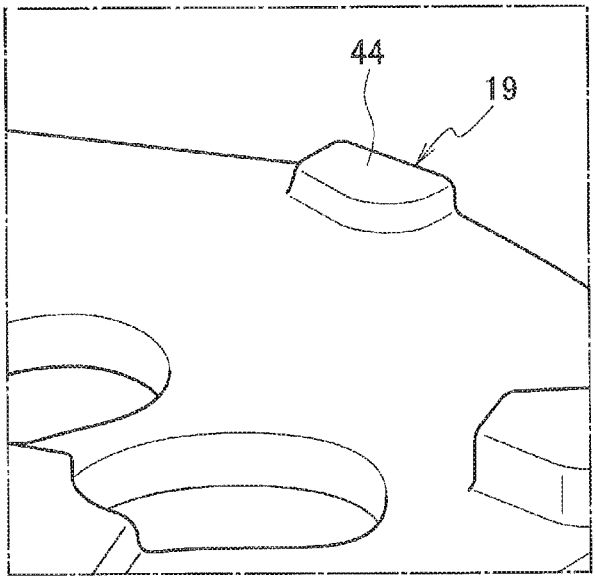
FIG. 8 is an enlarged view of a part III of FIG. 6.

As described above, each of the engaged portions 15 of the aligning plate 7 include the L-shaped projecting portion 40 as illustrated in FIGS. 6 and 7 and other drawings. The projecting portion 40 has an L shape in side view. The engaged portions 15 are provided in a pair.

In more detail, the projecting portion 40 is configured to include a flat portion 53 and the bent portion 46 as illustrated in FIG. 7 and other drawings. The flat portions 53 protrude upward from the both ends of the aligning plate 7 in the longitudinal direction at the middle part of the aligning plate 7 in the lateral direction in a state where the thickness direction of the flat portions 53 is in the longitudinal direction. The protrusion height of each of the projecting portions 40 is the smallest at one end in the lateral direction, and gradually increases toward the other end in the lateral direction.

The bent portion 46 protrudes toward the center of the aligning plate 7 at the upper end of the flat portion 53. In the part of the bent portion 46, the thickness of the flat portion 53 (longitudinal dimension) is larger than the rest part of the flat portion 53 by the thickness of the bent portion 46.

In addition, each of the engaged portions 15 is provided with a reinforcing rib 55. The reinforcing rib 55 protrudes toward the center of the aligning plate 7 similarly to the bent portion 46 bending at one end of the flat portion 53 in the lateral direction. In the part of the reinforcing rib 55, the thickness of the flat portion 53 (longitudinal dimension) is larger than the rest part of the flat portion 53 by the thickness of the reinforcing rib 55 similarly to the part of the bent portion 46.

The female connector housing 21 of the female connector 5 is formed to have a rectangular shape. When the female connector 5 is installed in the male connector 3, the female connector 5 is inserted into the hood portion 39 of the male connector 3. At this time, the vertical direction of the female connector 5 and the vertical direction of the male connector 3 are aligned with each other, the lateral direction of the female connector 5 and the lateral direction of the male connector 3 are aligned with each other, and the longitudinal direction of the female connector 5 and the longitudinal direction of the male connector 3 are aligned with each other.

From the both end surfaces of the female connector 5 (the female connector housing 21) in the longitudinal direction, the pair of cylinder-shaped first protrusions 36A and the pair of cylinder-shaped second protrusions 36B slightly protrude. Each of the protrusions 36A and 36B is positioned closer to one end in the lateral direction.

The lever 31 includes a portal-shaped lever main body 42. In more detail, the lever main body 42 includes a flat first portion 61, a flat second portion 63, and a third portion 65. The flat first portion 61 and the flat the second portion 63 are formed to have approximately identical shapes. The other ends of the flat first portion 61 and the flat second portion 63 in the lateral direction are connected to each other through the third portion 65, whereby a portal shape is formed. The flat first portion 61 and the flat second portion 63 extend in parallel to each other.

The first through holes 34A and the second through holes 34B are formed to have an arc shape and penetrate through the first portion 61 and the second portion 63 in the thickness direction of the first portion 61 and the second portion 63. When the lever 31 is installed on the female connector 5, the first protrusions 36A are inserted into the first through holes 34A, and the second protrusions 36B are inserted into the second through holes 34B, whereby the flat first portion 61 and the flat second portion 63 sandwich the female connector 5 in the lateral direction. The lever 31 then makes the constrained motion with respect to the female connector 5 as described above.

The protruding portions 44 constituting the engaging portions 19 of the lever 31 protrude respectively from the outer surface of the flat first portion 61 and the outer surface of the flat second portion 63.

In the connector 1, the female connector 5 and the aligning plate 7 are installed in the male connector 3 through the following operation.

As an initial state, the aligning plate 7 is temporarily installed in the male connector 3, and the female connector 5 is separated from the male connector 3 and the aligning plate 7 as illustrated in FIGS. 12, 13A, and 13B.

In a state where the aligning plate 7 is temporarily mounted in the male connector 3, the aligning plate 7 engages with intermediate portions of the male terminals in the longer direction of the male terminals, and the pawl portions 43 of the locking portions 11 of the male connector 3 are inserted into the recessed portions 59 of the locked portion 17 of the aligning plate 7 so that the aligning plate 7 is locked to the male connector 3.

When mounting of the female connector 5 in the male connector 3 starts in a state where the aligning plate 7 is temporarily mounted in the male connector 3, the female connector 5 is positioned above the aligning plate 7.

Pushing the lever 31 downward (downward movement of the lever 31) from the initial state causes the female connector 5 to move downward. Thus, protrusions 57 of the female connector 5 abut against the abutting portions 45 of the locking portions 11 of the male connector 3, the elastic arms 41 bend outward, and the lock of the aligning plate 7 is released (refer to FIGS. 15A and 15B). In addition, the female connector 5 abuts against the aligning plate 7.

Figure 17A:
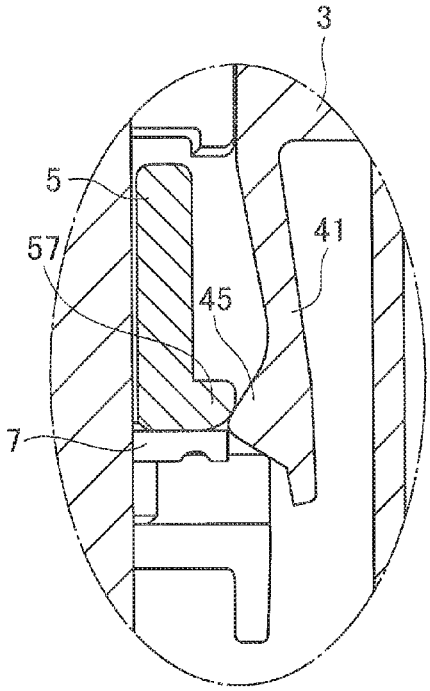
FIG. 17A is an enlarged view of a part XVIIA in FIG. 16.
Figure 17B:
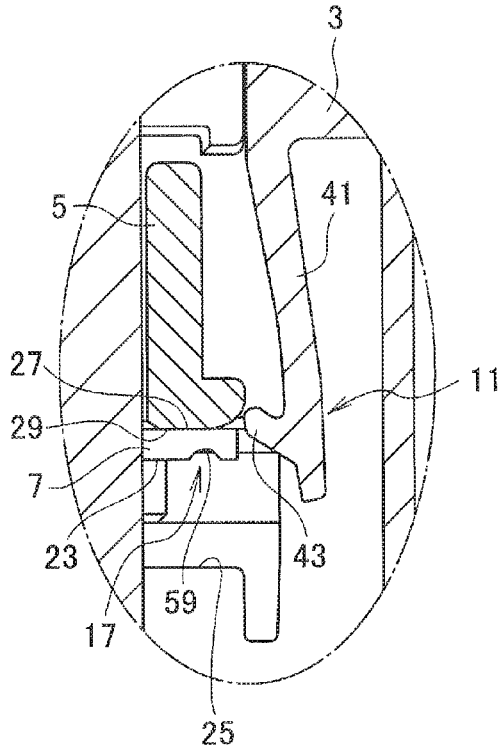
FIG. 17B is a drawing illustrating the locking portion and the locked portion in the state of FIG. 16.

Further pushing the lever 31 downward causes the female connector 5 to move further downward, the protrusions 57 of the female connector 5 further push the abutting portions 45 of the locking portions 11, and the elastic arms 41 further bend (refer to FIGS. 17A and 17B). At this time, the protruding portions 44 of the lever 31 start to get into the lower side of the bent portions 46 of the projecting portions 40 of the aligning plate 7 (refer to FIG. 16).

Figure 19A:
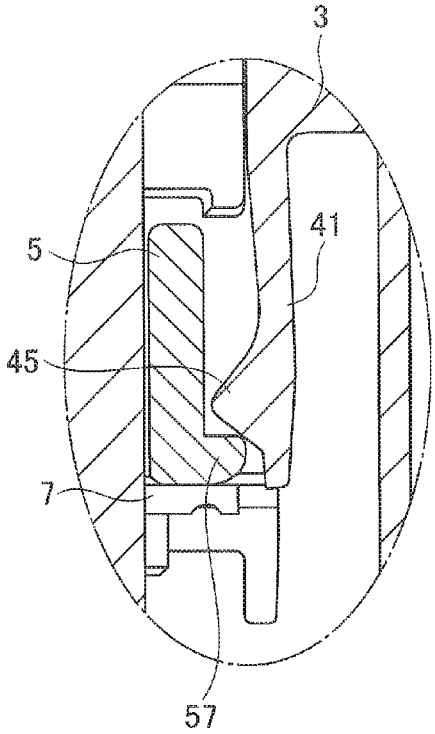
FIG. 19A is an enlarged view of a part XIXA in FIG. 18.
Figure 19B:
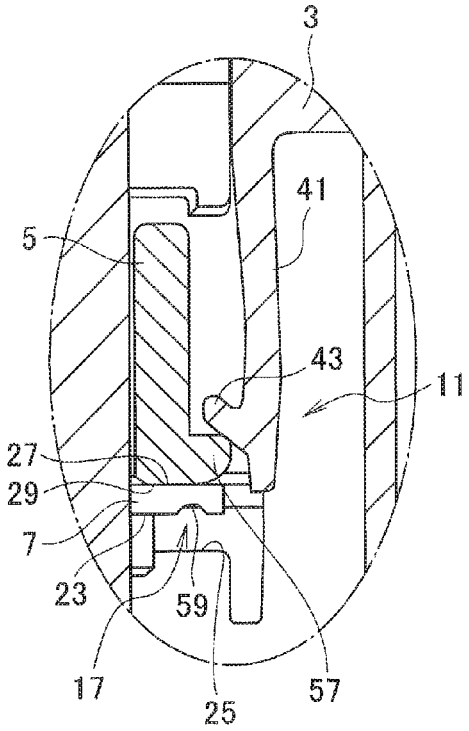
FIG. 19B is a drawing illustrating the locking portion and the locked portion in the state of FIG. 18.

Next, further pushing the lever 31 downward causes the female connector 5 to move further downward, the protrusions 57 of the female connector 5 get over the hook portions 43 of the locking portions 11, and thus the elastic arms 41 are restored to their original shape (refer to FIGS. 19A and 19B).

The further movement of the female connector 5 downward causes a lower surface 23 of the aligning plate 7 to abut against an upper surface 25 of a portion of the male connector housing 13 where the male terminals protrude, and an upper surface 27 of the aligning plate 7 abuts against a lower surface 29 of a portion of the female connector housing 21 where the female terminals are provided (refer to FIGS. 18, 19A, and 19B). Thus, the installation of the aligning plate 7 and the female connector 5 in the male connector 3 is completed (refer to FIGS. 20, 21A, and 21B).

The connector 1 is configured such that the female connector 5 is detached from the male connector 3 through the following operation (reverse operation of the installation).

In removing the aligning plate 7 and the female connector 5 from a state where the mounting of the aligning plate 7 and the female connector 5 in the male connector 3 is finished (from a state where the aligning plate 7 and the female connector 5 are connected to the male connector 3), the female connector 5 moves upward by pulling up the lever 31.

The upward movement of the female connector 5 causes the protruding portions 44 of the lever 31 inserted in the lower side of the bent portions 46 of the projecting portions 40 of the aligning plate 7 to push the bent portions 46 upward. Thus, the aligning plate 7 starts to move upward, and the lever 31 and the female connector 5 start to move upward.

Next, further pulling the lever 31 upward causes the aligning plate 7 to move upward and the lever 31 and the female connector 5 to move upward. Thus, the protrusions 57 of the female connector abut against guide surfaces 52 of the locking portions 11 of the male connector 3, and the elastic arms 41 start to bend outward (refer to FIGS. 18, 19A, and 19B).

Figure 15A:
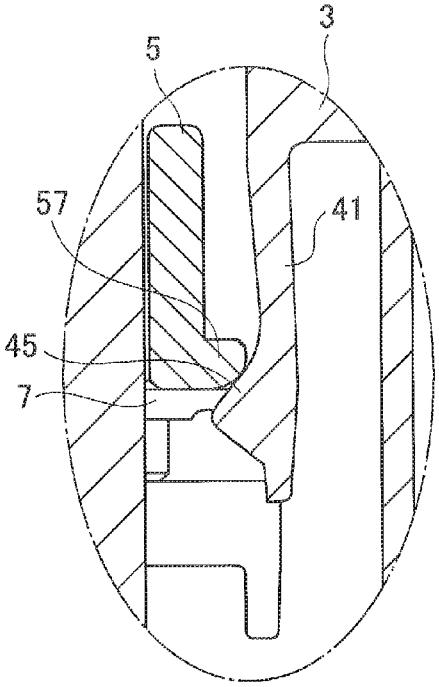
FIG. 15A is an enlarged view of a part XVA in FIG. 14.
Figure 15B:
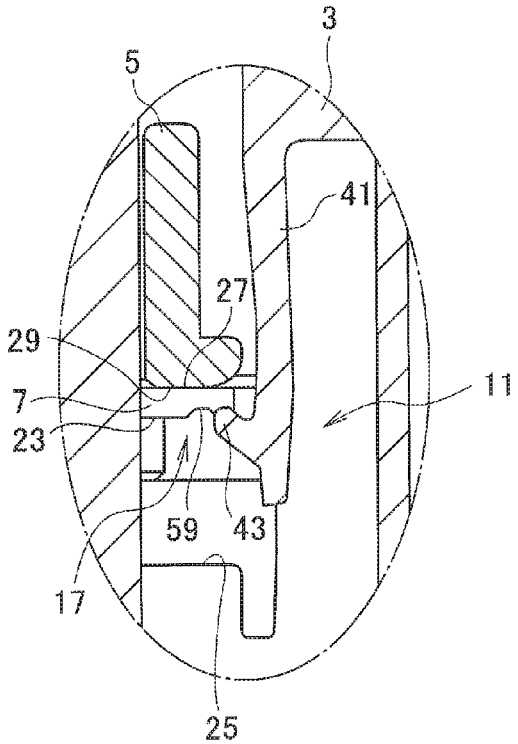
FIG. 15B is a drawing illustrating the locking portion and the locked portion in the state of FIG. 14.
Figure 16:
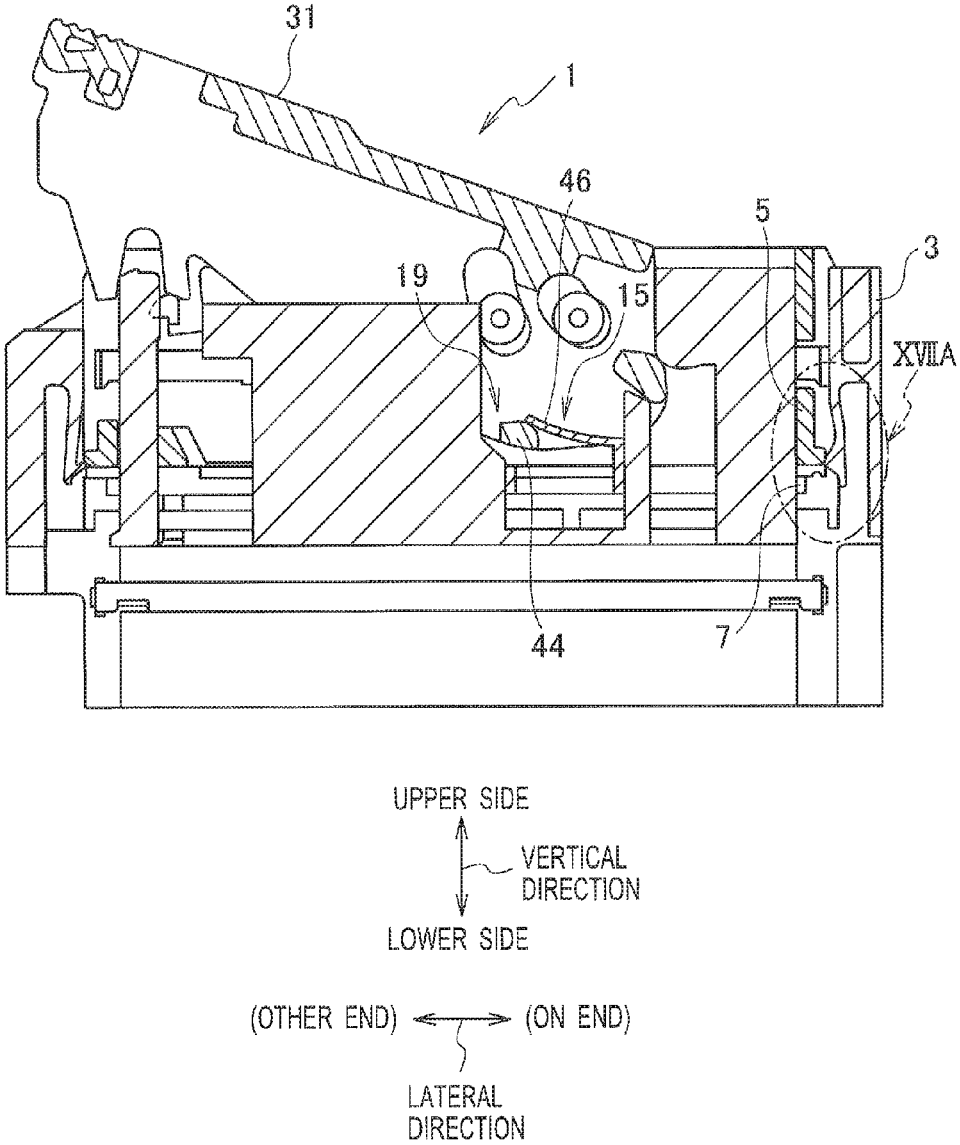
FIG. 16 is a drawing illustrating operation of the connector according to the embodiment of the present invention.

Next, further pulling the lever 31 upward causes the protrusions 57 of the female connector 5 to get over the hook portions 43 of the locking portions 11, and thus the elastic arms 41 are restored to their original shape (refer to FIGS. 15A and 15B). The aligning plate 7 moves further upward, and the protruding portions 44 of the lever 31 having been in the lower side of the bent portions 46 of the projecting portions 40 of the aligning plate 7 move out from the bent portions 46 (refer to FIG. 14) to make an engaged state of the protruding portions 44 and the bent portions 46 (the engaging portions 19 and the engaged portions 15 make an engaged state). Thus, the aligning plate 7 is temporarily mounted in the male connector 3 and the upward movement of the aligning plate 7 is stopped. Meanwhile, the female connector 5 and the lever 31 continue to move upward.

Next, further pulling the lever 31 upward causes the aligning plate 7 and the lever 31 to move further upward, and the female connector 5 and the lever 31 are detached from the male connector 3 and the aligning plate 7 (refer to FIGS. 12, 13A, and 13B).

Since the connector 1 is configured such that in a state where the locked portions 17 are provided on the surface on closer to the base end of the aligning plate 7 (lower surface), and the aligning plate 7 is temporarily installed in the male connector 3, the locked portions 17 abut against the locking portions 11 of the male connector and the movement of the male connector 3 toward the base end (lower side) is prevented. Thus, even with large force (load) applied in the temporal lock (temporal installation) state, the aligning plate 7 does not move toward the male connector unlike the conventional technique.

In addition, the connector 1 is configured such that during detachment of the female connector 5 and the aligning plate 7 from the male connector 3 from the state where the aligning plate 7 and the female connector 5 are installed in the male connector 3, the engaging portions 19 of the lever 31 engage with the engaged portions 15 of the aligning plate 7 and the aligning plate 7 moves away from the male connector 3 (upward). Thus, it is easy to detach the aligning plate 7, which is once installed, from the male connector 3.

Further, the connector 1 is configured such that during detachment of the female connector 5 and the aligning plate 7 from the male connector 3 from the state where the aligning plate 7 and the female connector 5 are installed in the male connector 3, the engaged portions 15 of the aligning plate 7 are engaged with the engaging portions 19 of the lever 31 until the aligning plate 7 is brought into the temporal installation state. Thereafter, the engagement state of the engaged portions 15 of the aligning plate 7 and the engaging portions 19 of the lever 31 is released. The connector 1 is also configured such that in the state where the aligning plate 7 is temporarily installed, the aligning plate 7 does not easily move toward the tip end of the male terminal (upper side), and the aligning plate 7 is integrated with the male connector 3. Thus, during delivery of the connector 1, the aligning plate 7 is not detached from the male connector 3 and the male terminal is not exposed to protect the male terminal.

In addition, in a state where the female connector 5 is detached from the male connector 3, the female connector 5 and the lever 31 are integrated and the male connector 3 is integrated with the aligning plate 7 temporarily installed in the male connector 3, whereby the connector 1 include two components. Thus, assembling work of the connector 1 is simplified and made easy.

Further, according to the connector 1, each of the first protrusions 36A is inserted into corresponding one of the first through hole 34A, the first through hole 34A and the first protrusion 36A engage with each other as a pair, each of the second protrusions 36B is inserted into corresponding one of the second through hole 34B, and the second through hole 34B and the second protrusion 36B engage with each other as a pair. Thus, a simple configuration can realize the constrained motion of the lever 31 with respect to the female connector 5.

Still further, the connector 1 is configured such that when the engaging portions 19 of the lever 31 engage with the engaged portions 15 of the aligning plate 7, the protruding portions 44 of the lever 31 abut against the bent portions 46 of the L-shaped tip ends of the projecting portions 40 of the aligning plate 7. Thus, when the lever 31 moves the aligning plate 7 upward, the engaging portions 19 of the lever 31 or the engaged portions 15 of the aligning plate 7 do not bend. Therefore, strength can be improved and a space for bending is not required, enabling downsizing of the connector 1.

Although the embodiment of the present invention has been described heretofore, the embodiment is merely exemplified for facilitating the understanding of the present invention, and the present invention is not limited to the embodiment. The technical scope of the present invention may include not only the specific technical matters disclosed in the above-described embodiment but also various modifications, changes, and alternative techniques easily derived from the above-described specific technical matters.

What is claimed is:

1. An electrical connector comprising:

a male connector; an aligning plate; a female connector; and a lever, wherein the male connector is provided with a male terminal and a locking portion, the aligning plate engages with the male terminal and is movable with respect to the male connector in a protruding direction of the male terminal in order to perform at least protection of the male terminal or correction of alignment of the male terminal, the aligning plate is provided with a locked portion and the male terminal on a surface closer to a base end of an engaged portion, and the locked portion abuts against the locking portion of the male connector in a state where the aligning plate is temporarily installed in the male connector, whereby movement of the male terminal toward the base end is prevented, the female connector is configured together with the aligning plate to be installed into the male connector by moving toward the male connector, and the lever comprises an engaging portion and is provided on the female connector so as to make predetermined constrained motion with respect to the female connector, the lever is configured such that the engaging portion of the lever engages with an engaged portion of the aligning plate by making the constrained motion with respect to the female connector in a predetermined direction during detachment of the female connector and the aligning plate from the male connector from a state where the aligning plate and the female connector are installed in the male connector, and the lever is configured so as to move the aligning plate away from the male connector.

2. The electrical connector according to claim 1, wherein the predetermined constrained motion of the lever is constrained motion of a link opposite to a fixed link where the female connector is assumed as the fixed link of quadric chain, during detachment of the female connector and the aligning plate from the male connector from the state where the aligning plate and the female connector are installed in the male connector, the engaged portion of the aligning plate is engaged with the engaging portion of the lever until the aligning plate comes to the temporal installation state, and the aligning plate is configured to prevent movement of the male terminal toward a tip end in the temporal installation state.

3. The electrical connector according to claim 2, wherein the lever is formed with an arc-shaped first through hole and an arc-shaped second through hole, the female connector is provided with a cylinder shaped first protrusion and a cylinder shaped second protrusion, and the first protrusion is inserted into the first through hole, the first through hole and the first protrusion engage with each other as a pair, the second protrusion is inserted into the second through hole, and the second through hole and the second protrusion engage with each other as a pair.

4. The electrical connector according to claim 1, wherein the engaged portion of the aligning plate is configured as an L-shaped projecting portion that protrudes from a main body of the aligning plate and can be regarded as a rigid body, the engaging portion of the lever is configured as a protruding portion that protrudes from a main body of the lever and can be regarded as a rigid body, and when the engaging portion of the lever engages with the engaged portion of the aligning plate, the protruding portion of the lever abuts against a bent portion of a tip end of the L-shaped projecting portion of the aligning plate.

* * * * *